US008082733B2

(12) United States Patent
Grissom et al.

(10) Patent No.: US 8,082,733 B2
(45) Date of Patent: Dec. 27, 2011

(54) AIR HANDLING SYSTEM WITH AFTER-TREATMENT

(75) Inventors: Thomas A. Grissom, Dexter, MI (US); Steven R. McKinley, Rochester, MI (US)

(73) Assignee: BorgWarner Inc., Auburn Hills, MI (US)

( * ) Notice: Subject to any disclaimer, the term of this patent is extended or adjusted under 35 U.S.C. 154(b) by 446 days.

(21) Appl. No.: 12/085,122

(22) PCT Filed: Nov. 14, 2006

(86) PCT No.: PCT/US2006/044106

§ 371 (c)(1), (2), (4) Date: May 5, 2009

(87) PCT Pub. No.: WO2007/061680

PCT Pub. Date: May 31, 2007

(65) Prior Publication Data

US 2009/0223205 A1 Sep. 10, 2009

Related U.S. Application Data

(60) Provisional application No. 60/738,158, filed on Nov. 18, 2005.

(51) Int. Cl.
*F01N 3/10* (2006.01)

(52) U.S. Cl. ..... 60/303; 60/280; 60/286; 60/289; 60/293; 60/295

(58) Field of Classification Search ..... 60/274, 60/280, 286, 289, 293, 295, 300, 303, 307, 60/311

See application file for complete search history.

(56) References Cited

U.S. PATENT DOCUMENTS

| | | | | |
|---|---|---|---|---|
| 5,063,737 | A * | 11/1991 | Lopez-Crevillen et al. | 60/286 |
| 6,786,041 | B2 * | 9/2004 | Itoh et al. | 60/274 |
| 7,337,607 | B2 * | 3/2008 | Hou et al. | 60/274 |
| 7,406,822 | B2 * | 8/2008 | Funke et al. | 60/297 |
| 7,571,602 | B2 * | 8/2009 | Koch | 60/286 |
| 7,673,447 | B2 * | 3/2010 | Gaiser | 60/289 |
| 7,735,315 | B2 * | 6/2010 | Bareis et al. | 60/303 |
| 2005/0274107 | A1 | 12/2005 | Liu et al. | |

FOREIGN PATENT DOCUMENTS

| | | |
|---|---|---|
| DE | 4 340 742 | 6/1995 |
| DE | 10 203 309 | 7/2003 |
| DE | 10 2004 019659 | 12/2004 |
| EP | 1 491 735 | 12/2004 |
| EP | 1 752 632 | 2/2007 |
| WO | WO 95/15431 | 6/1995 |
| WO | WO 03/083272 | 10/2003 |
| WO | WO 2005/045208 | 5/2005 |
| WO | WO 2005/124917 | 12/2005 |

* cited by examiner

*Primary Examiner* — Binh Q. Tran
(74) *Attorney, Agent, or Firm* — Warn Partners, P.C.

(57) ABSTRACT

The present invention is a turbocharger (18) and control system based strategy to control exhaust gas filters (30) for aftertreatment regeneration. The air handling system (10) uses the variable turbine geometry (VTG) of the turbine (20) and a compressor (22) flow control bleed valve (24) to drive pressurized intake air into the exhaust. The oxygen rich exhaust gas can then be mixed with fuel and combusted. Increasing the temperature of the exhaust gas will combust the excess exhaust gas emissions and reduce the pressure drop across the filter (30). This system (10) can be used under any operating conditions so as to be available to combust the excess exhaust gas emissions when needed.

22 Claims, 1 Drawing Sheet

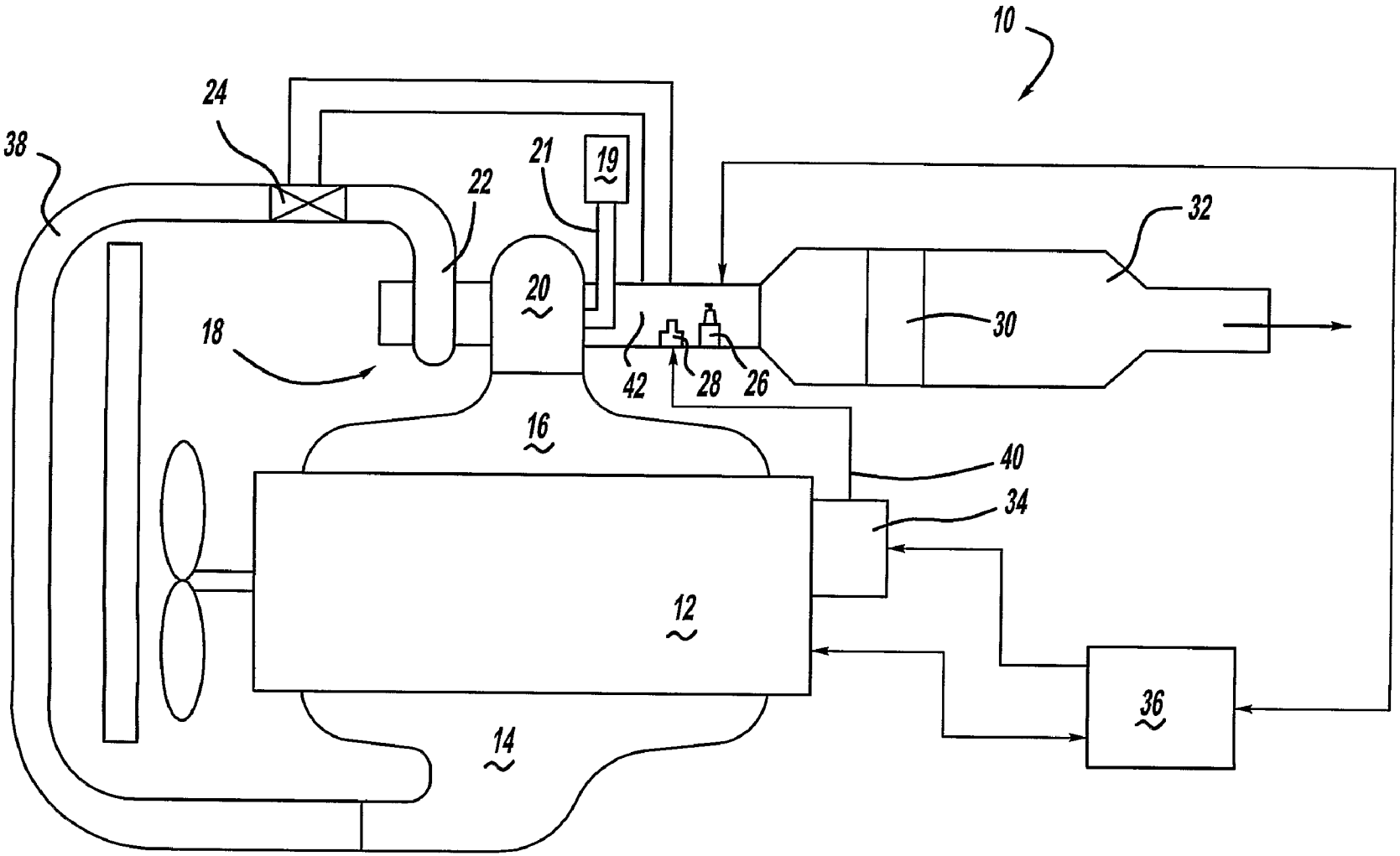
FIGURE

AIR HANDLING SYSTEM WITH AFTER-TREATMENT

CROSS-REFERENCE TO RELATED APPLICATIONS

This application claims the benefit of U.S. Provisional Application No. 60/738,158, filed Nov. 18, 2005.

This application is a National Stage of International Application No. PCT/US2006/044106, filed Nov. 4, 2006. This application claims priority to Provisional Patent Application No. 60/738,158 filed on Nov. 18, 2005. The disclosures of the above applications are incorporated herein by reference.

FIELD OF THE INVENTION

The present invention generally relates to turbocharged vehicles and more particularly to a device for secondary combustion in a vehicle exhaust system, the intended purpose of which is to provide heat for regeneration of catalyst and/or incineration of deposits in a particle trap. The device of the present invention is capable of being operated completely independent of engine operation, and is particularly suitable for turbocharged diesel-powered vehicles.

BACKGROUND OF THE INVENTION

Turbochargers are commonly used to significantly increase the power of an internal combustion engine or a diesel engine in a vehicle. A typical problem that exists with the use of turbochargers is the increase of exhaust emissions comprising of particulate matter (PM), hydrocarbons (HC) and oxides of nitrogen (NOx). Many diesel engines are being developed with aftertreatment systems to reduce emissions of PM, HC and NOx.

These systems often include downstream filters and traps to store the unwanted by-products of combustion until a regeneration cycle can be initiated. A regeneration cycle is a process in which excess emissions of PM, HC, and NOx are "burned off." Regeneration cycles typically require a specific temperature range and/or exhaust gas oxygen concentration to be effective, and operate for extended periods of time. Typically, during normal operating conditions, i.e., when the engine has been running to generate enough heat and is operating at a high enough speed, the amount of heat and oxygen necessary to combust the excess exhaust emissions is provided and the excess exhaust emissions will automatically combust, or burn off. Combustion of these excess exhaust emissions is important because build-up of PM, HC, and NOx can block the flow of exhaust gas, thus building up pressure in the exhaust line and affecting engine performance.

One difficulty with the requirements of a specific temperature range and oxygen concentration occurs during vehicle start up, e.g., when the engine has not reached its normal operating temperature, and another occurs during low-speed operation, such as when the vehicle is at a stop light and air flow through the system is not high enough to allow for the proper amount of oxygen to be present to combust the excess emissions automatically. During these types of conditions, the excess emissions can build up in the filter or trap.

Accordingly, there exists a need for a new and improved air handling system for a turbocharger system for a vehicle.

SUMMARY OF THE INVENTION

The present invention is an air handling system for a turbocharger and control system based strategy to control exhaust gas filters for aftertreatment regeneration.

The turbocharger-based regeneration system of the present invention uses variable turbine geometry (VTG) and a compressor flow control valve to drive pressurized intake air into the exhaust. The oxygen rich exhaust gas can then be mixed with fuel and combusted, increasing its temperature to the point where the filter regenerates and the PM is combusted as well. Variable turbine geometry is used to increase, compressor discharge pressure under any engine speed and load conditions. The excess compressor pressure and flow are diverted into the exhaust gas system upstream of the particulate filter. A variable orifice on the discharge side of the compressor regulates the volume flow and maintains the required engine intake manifold conditions. Transient operation of the engine during regeneration is accomplished through a closed-loop control of the VTG mechanism and compressor discharge orifice to maintain engine load and exhaust gas temperature.

The present invention is an air handling system with aftertreatment for an exhaust gas turbocharger for eliminating excess particulate matter having an intake manifold for introducing air into the engine, an exhaust manifold for removing the exhaust gases away from the engine, a turbine which receives the exhaust gases from the exhaust manifold, and a compressor for receiving, compressing, and forcing air into an intake line. The present invention also includes a filter located in an exhaust gas conduit for capturing excess exhaust gas particulate matter in the exhaust gases, a fuel source connected to a fuel pump through the use of a fuel line, and an ignition source positioned in a relationship with the fuel source such that the ignition source can ignite the fuel introduced into the exhaust gas conduit from the fuel source. A bleed valve is mounted inside the intake pipeline and connected to the exhaust gas conduit which introduces fresh air from the intake pipeline into the exhaust gas conduit to mix with the fuel introduced by the fuel source. Once the fresh air and fuel are mixed inside the exhaust gas conduit, the ignition source creates a spark, producing a combustion flame, burning off the exhaust gas particulate matter that has accumulated on the filter.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

The FIGURE is a diagram of an exhaust gas aftertreatment system, according to the present invention.

DETAILED DESCRIPTION OF THE PREFERRED EMBODIMENTS

The following description of the preferred embodiment(s) is merely exemplary in nature and is in no way intended to limit the invention, its application, or uses.

Referring to the FIGURE, an air handling system 10 is generally shown with aftertreatment for an exhaust gas turbocharger for use in an internal combustion engine. The engine 12 includes an intake manifold 14 and an exhaust manifold 16 for conducting exhaust gas emissions away from the engine 12. The exhaust manifold 16 is operably associated with a turbocharger, generally shown at 18, having an actuator 19 and a turbine 20 which receives the exhaust gases from the exhaust manifold 16. The turbine 20 can be a variable turbine geometry (VTG) turbine having an actuator 19 connected to the turbine 20 by a link 21. The turbine 20 having variable turbine geometry can be of any type. The VTG turbine 20 is controlled by the actuator 19 and the link 20. As the turbine 20 rotates from the exhaust gas flow the turbine 20 powers a compressor 22. The compressor 22 receives, compresses, and forces fresh air through the bleed valve 24.

The present invention also includes an ignition source, which in this case is an igniter 26 for producing a spark. The igniter 26 is located in proximity to a fuel source, or fuel injector 28. Both the igniter 26 and the fuel injector 28 are operably associated with a filter 30. The filter 30 captures excess exhaust gas emissions such as particulate matter (PM) that has not burned off during the normal operation of the engine 12. The filter 30 is located inside a muffler 32. The muffler 32 delivers the exhaust gas into the atmosphere.

The present invention also includes a fuel pump 34, for delivering fuel to the fuel injector 28, and is controlled by the vehicle's electronic control unit (ECU) 36. The bleed valve 24 is located in an intake conduit 38, and can divert some or all of the compressed fresh air from the compressor 22 into the intake manifold 14. The fuel injector 28 and the fuel pump 34 are connected by a fuel line 40, in which the fuel pump 34 delivers fuel to the fuel injector 28 when commanded to do so by the ECU 36. The igniter 26 and the fuel injector 28 are located inside of an exhaust gas conduit 42. Exhaust gas flows out of the engine 12, is collected by the exhaust manifold 16, and fed through the turbine 20 and into the exhaust gas conduit 42. The exhaust gas then flows into the muffler 32 where the filter 30 collects any exhaust gas PM that did not burn off when combusted in the engine 12.

Under normal operation of the engine 12, fuel is injected into the engine by the fuel pump 34. The fuel pump 34 is controlled by the electronic control unit (ECU) 36. The ECU 36 also controls the aftertreatement system by monitoring the condition of the muffler 32, the filter 30, and the fuel injector 28. Monitoring the fuel injector 28 can be accomplished by using a fuel pressure regulator (not shown) for monitoring the correct fuel pressure going into the engine 10 or the injector 28.

The igniter 26 can be a spark plug or some other type of device which can produce the necessary spark to ignite the air-fuel mixture in the combustion chamber. As fuel is injected into the exhaust gas conduit 42, the turbulence of the hot exhaust gases exiting the turbine 20 disperses the fuel inside the exhaust gas conduit 42. Fresh air is introduced into the exhaust gas conduit 42 by bleed valve 24. The bleed valve 24 is located in connection with conduit 38. Conduit 38 delivers compressed air from the compressor 22 to intake manifold 14. When the bleed valve 24 is opened, fresh air is diverted inside the conduit 38 into exhaust gas conduit 42. The swirling air-fuel mixture is ignited within the exhaust gas conduit 42, thereby producing a combustion flame. The result is the combustion flame increases the temperature of the exhaust gases flowing toward the filter 30 located inside the muffler 32, causing any excess exhaust emissions to combust.

The filter 30 may be comprised of ceramic material to withstand the severe heat of the exhaust gases, or may be comprised of some other high-temperature resistant material capable of collecting PM contained in the exhaust gas.

The ECU 36 also preferably has control over the operation of the regeneration cycle in the aftertreatment system. The volume of excess exhaust emissions may be determined by reading the pressure differential on each side of the filter 30. For instance, a pressure sensor can be placed upstream of the filter 30, as well as downstream of the filter 30, and the pressure differential can be measured between the two sensors. If the pressure differential reaches a certain predetermined value such that the amount of exhaust emissions begins to affect the performance of the engine 12, the ECU 36 will activate the fuel injector 28 and the igniter 26 to produce the combustion flame, thus causing any excess exhaust emissions that have built up on the filter 30, such as PM, to combust and burn off. Once the excess emissions have burned off, the ECU 36 will read that the pressure change across the filter 30 is acceptable, and de-activate the fuel injector 28 and the igniter 26. It should be noted that instead of reading the pressure drop across the filter 30, thermocouples or some other temperature reading devices could be used to sense the change in temperature across the filter 30. Because the combustion flame increases the exhaust gas temperature, once the temperature is similar on both sides of the filter 30, the exhaust gas will be hot enough to burn off any excess exhaust emissions that may have accumulated on the filter 30.

In operation, the exhaust gas flows from the engine 12, and into the exhaust manifold 16. The exhaust gas pressure then begins to activate the turbine 20, which in turn drives compressor 22. After the exhaust gases flow out of the turbine 20, they flow through the exhaust gas conduit 42, and then into the muffler 32. As the exhausts gases flow through the muffler 32, the filter 30 captures any excess exhaust emissions, such as PM, that did not burn off upon combustion in the engine 12.

Under normal operating conditions, when the exhaust gas is hot enough, the PM will burn off, i.e. combust, because of the heat from the exhaust gas. When the exhaust gas temperature is not high enough to burn off the excess PM, the PM will build up on the filter 30. This build up causes a pressure build up, or backpressure, of the exhaust flow gases in the exhaust gas conduit 42. The ECU 36 reads the pressure change across the filter 30. If the pressure reaches a certain predetermined value, the ECU 36 triggers the activation of the fuel injector 28 and the igniter 26. PM is burned off by the fuel injector 28 injecting fuel into the exhaust gas conduit 28. As this occurs, bleed valve 24 opens up, allowing for fresh air to flow into the exhaust gas conduit 42. With air and fuel in the exhaust gas conduit 42, the igniter 26 introduces a spark, which ignites the air-fuel mixture, burning off any excess PM that has built up on the filter 30, eliminating any backpressure resulting from the PM buildup inside the muffler 32. The pressure reading by the ECU 36 can be independent of engine operating conditions. The ECU 36 can also be programmed to activate the aftertreatment system at a specified time interval, with the specified time interval being the maximum allowable time interval between activations.

The igniter 26 can be powered by the vehicle battery, which is typically 12 volts, or it can be powered by some other device capable of providing an electric current to the igniter 26, such as a separate battery. Once the aftertreatment cycle is started, the igniter 26 can be deactivated, and the combustion flame will remain continuous as long as the fuel injector 28 continues to supply fuel into the exhaust gas conduit 42. Once the aftertreatment cycle is completed, the fuel injector 28 is deactivated, and the bleed valve 24 is closed, such that all the fresh air is directed into the intake manifold 14.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An air handling system, comprising:

an intake manifold for introducing air into an engine;

an exhaust manifold for removing exhaust gases from said engine;

an exhaust gas conduit connected to said exhaust manifold, for delivering said exhaust gases to the atmosphere;

a filter located in said exhaust gas conduit for capturing excess exhaust gas emissions from said exhaust gas conduit;

an ignition source operably associated with said filter;

a fuel source located in proximity to said ignition source;

a bleed valve mounted inside an intake conduit, and connected to said exhaust gas conduit such that said bleed valve is operable to direct all of said air flowing from said intake conduit into said exhaust gas conduit; and wherein when said bleed valve selectively directs said air from said intake conduit into said exhaust gas conduit, said fuel source will introduce fuel into said exhaust gas conduit, and said ignition source will produce a spark, igniting said air and said fuel.

2. The invention of claim 1, further comprising:

a fuel line connected to a fuel pump for said engine; and wherein said fuel pump provides fuel to said fuel source for combustion near said ignition source inside said exhaust gas conduit.

3. The invention of claim 2, wherein when said excess exhaust gas emissions do not naturally combust from the operation of said engine, said fuel source injects fuel, and said bleed valve introduces fresh air into said exhaust gas conduit near said ignition source, and said ignition source ignites said fuel, combusting said excess exhaust gas emissions.

4. The invention of claim 1, wherein said bleed valve introduces the necessary amount of air needed to combust said excess exhaust gas emissions.

5. The invention of claim 1, wherein said excess exhaust gas emissions comprise a material selected from the group consisting of particulate matter, hydrocarbons, oxides of nitrogen, and combinations thereof.

6. The invention of claim 1, further comprising:

a turbine for receiving said exhaust gases;

a compressor powered by said turbine; and wherein said compressor receives, compresses, and forces air into said intake manifold of said engine through said intake conduit.

7. An aftertreatment system for handling air from an exhaust gas turbine used in an engine, comprising:

an engine which intakes air, and releases pressurized exhaust gas;

a turbine, which rotates from the flow from said pressurized exhaust gas;

a compressor, which is powered by said turbine, and compresses air, forcing said air into an intake manifold of said engine;

an intake conduit, for placing said compressor in fluid connection with said intake manifold;

an exhaust gas conduit for conducting said pressurized exhaust gas away from said engine;

a filter for collecting excess exhaust gas emissions in said pressurized exhaust gas;

an ignition source, mounted in said exhaust gas conduit, in proximity to said filter;

a bleed valve located in said intake conduit for selectively directing all the flow of fresh air from said intake conduit into said exhaust gas conduit;

a fuel injector which introduces fuel into said exhaust gas conduit, operably associated with said ignition source;

a fuel pump for introducing fuel into said engine, and for supplying fuel to said fuel injector, through a fuel line; and wherein when said fuel and said air are introduced into said exhaust gas conduit, said ignition source ignites said fuel, burning off said excess exhaust gas emissions.

8. The invention of claim 7, wherein said bleed valve is mounted downstream from said compressor, and is connected to said exhaust gas conduit such that when actuated, said bleed valve introduces fresh air into said exhaust gas conduit to combine with said fuel that is ignited by said ignition source.

9. The invention of claim 7, wherein said turbine transfers power to and drives said compressor.

10. The invention of claim 7, wherein said fuel line is connected to a fuel pump of said engine.

11. The invention of claim 7, wherein said fuel line is connected to said fuel injector.

12. The invention of claim 7, wherein increasing the speed of said engine will increase the speed of said turbine and said compressor, which will also increase the flow of air through said exhaust gas conduit, thereby increasing the flow of fresh air from said bleed valve when said bleed valve is directing air into said exhaust gas conduit.

13. The invention of claim 7, wherein said excess exhaust gas emissions comprise a material selected from the group consisting of particulate matter, hydrocarbons, oxides of nitrogen and combinations thereof.

14. An air handling system for removing excess exhaust gas emissions from a turbocharger used in an engine, comprising:

an exhaust manifold for receiving exhaust gases from an engine;

a turbine for collecting said exhaust gases from said exhaust manifold, and introducing said exhaust gases into an exhaust gas conduit;

a compressor for compressing and forcing air into an intake manifold of said engine;

a filter for trapping excess exhaust gas emissions flowing from said exhaust gas conduit;

an ignition source positioned near said filter and located in said exhaust gas conduit;

an intake conduit in fluid communication with said intake manifold and said compressor;

a bleed valve located in said intake conduit downstream from said compressor, said bleed valve operable for directing all of said air from said intake conduit to said exhaust gas conduit;

a fuel source positioned near said ignition source and located in said exhaust gas conduit; and wherein when fuel is injected from said fuel source into said exhaust gas conduit, said bleed valve introduces air into said exhaust gas conduit, and a current is provided to said ignition source, a spark is created in said exhaust gas conduit, and said fuel is ignited, creating a combustion flame, burning off said excess exhaust gas emissions.

15. The system of claim 14, further comprising a muffler for directing said exhaust gases into the atmosphere, said muffler located downstream of said exhaust gas conduit.

16. The system of claim 15, wherein said filter is located inside of said muffler.

17. The system of claim 14, further comprising a fuel pump connected to, and for introducing fuel into, said engine, as well as for delivering fuel to said fuel source.

18. The system of claim 17, further comprising the step of providing a fuel line connected to said fuel source on a first end, and connected to said fuel pump of said engine on a second end.

19. The system of claim 14, wherein said filter is positioned such that said filter is operably associated with said ignition source and said fuel source.

20. The system of claim 14, wherein said bleed valve is connected to said exhaust gas conduit, and said bleed valve is used to control the flow of air from said compressor into said exhaust gas conduit and said intake manifold.

21. The system of claim 14, wherein the amount of excess exhaust gas emissions built up on said filter is determined by reading the amount of exhaust gas pressure in said muffler.

22. The system of claim 14, wherein air and said fuel are mixed inside said exhaust gas conduit before said fuel is ignited.

* * * * *

UNITED STATES PATENT AND TRADEMARK OFFICE

CERTIFICATE OF CORRECTION

PATENT NO. : 8,082,733 B2
APPLICATION NO. : 12/085122
DATED : December 27, 2011
INVENTOR(S) : Thomas A. Grissom et al.

It is certified that error appears in the above-identified patent and that said Letters Patent is hereby corrected as shown below:

Column 4,
Line 25 “exhausts” should be -- exhaust --.

Column 4,
Line 39 “gas conduit 28” should be -- gas conduit 42 --.

Signed and Sealed this
Ninth Day of April, 2013

Teresa Stanek Rea
*Acting Director of the United States Patent and Trademark Office*